US006333843B2

(12) United States Patent
Boie et al.

(10) Patent No.: US 6,333,843 B2
(45) Date of Patent: Dec. 25, 2001

(54) METHOD OF STARTING AN ELECTROMAGNETIC ACTUATOR OPERATING A CYLINDER VALVE OF A PISTON-TYPE INTERNAL-COMBUSTION ENGINE

(75) Inventors: Christian Boie, Aachen; Lutz Kather, Würselen; Günter Schmitz, Aachen; Frank Van der Staay, Würselen; Günter Rudolf Feyerl, Alsdorf, all of (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 09/736,196

(22) Filed: Dec. 15, 2000

Related U.S. Application Data

(63) Continuation of application No. 09/574,253, filed on May 19, 2000.

(30) Foreign Application Priority Data

May 19, 1999 (DE) ..... 199 22 971

(51) Int. Cl.[7] ..... H01H 47/00; F01L 9/04

(52) U.S. Cl. ..... 361/140; 361/78; 361/139; 361/140; 361/143; 361/152; 361/153; 361/154; 123/90.11

(58) Field of Search ..... 361/139, 140, 361/143, 152, 153, 154, 78; 251/129.01, 129.02, 129.15; 123/90.11; 307/414, 415, 10.6

(56) References Cited

U.S. PATENT DOCUMENTS 5,636,601 * 6/1997 Moriya et al. ..... 123/90.11
5,771,884 * 6/1998 Yarnell et al. ..... 128/205.24
6,085,704 * 7/2000 Hara ..... 123/90.11

* cited by examiner

*Primary Examiner*—Josie Ballato
*Assistant Examiner*—Vaughn Marquis
(74) *Attorney, Agent, or Firm*—Venable; Gabor J. Kelemen

(57) ABSTRACT

A method for starting up an electromagnetic actuator operating an engine cylinder valve. The actuator has two spaced electromagnets, between which an armature, connected to the cylinder valve, is reciprocated against a restoring spring from a center position to lie against a magnet pole face. An ECU alternatingly supplies the electromagnets with a capturing current, the level of which is regulated as a function of the approach of the armature toward a pole face, as detected by a sensor assembly. A reference temperature is detected for the magnets, and, at a normal temperature, the armature starts oscillating due to the alternating energization of the electromagnets, and is brought into contact with a pole face. Or, at a low temperature level, one of the electromagnets is supplied with a high current pulse.

11 Claims, 1 Drawing Sheet

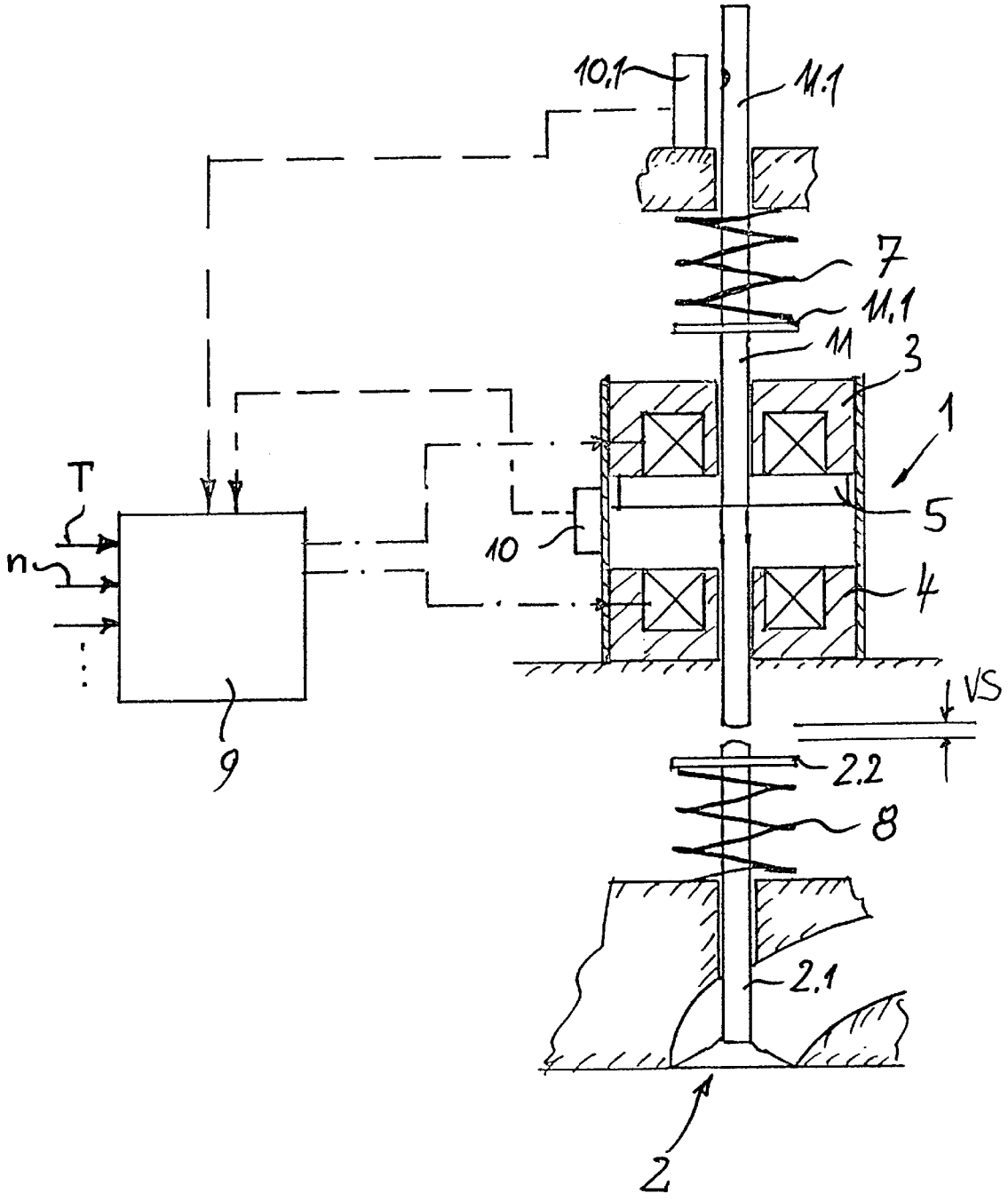
10.1
11.1
7
11.1
11
3
1
5
4
T
n
10
9
VS
2.2
8
2.1
2

METHOD OF STARTING AN ELECTROMAGNETIC ACTUATOR OPERATING A CYLINDER VALVE OF A PISTON-TYPE INTERNAL-COMBUSTION ENGINE

CROSS-REFERENCE TO RELATED APPLICATIONS

This application is a continuation of U.S. patent application Ser. No. 09/574,253 filed May 19, 2000.

This application claims the priority of German application No. 199 22 971.6 filed May 19, 1999, which is incorporated hereby by reference.

BACKGROUND OF THE INVENTION

An electromagnetic actuator for operating a cylinder valve in a piston-type internal-combustion engine essentially comprises two spaced electromagnets, whose pole faces are oriented toward one another. An armature connected to the cylinder valve to be actuated is guided back and forth between the pole faces against the force of restoring springs. When the armature is at rest, it is located in its center position between the two pole faces. As the two electromagnets are alternatingly energized, the armature arrives into contact with the pole face of the momentarily energized (capturing) electromagnet against the force of a restoring spring. If the holding current force of the restoring spring accelerates the armature in the direction of the other electromagnet which is energized with a capturing current during the armature movement. As a result, after overshooting the center position, the armature arrives into contact with the other, capturing electromagnet against the force of the restoring spring associated with the last-mentioned electromagnet. One of the electromagnets serves as a closing magnet holding the cylinder valve in a closed position against the force of the opening spring (that is, one of the restoring springs), while the other electromagnet serves as an opening magnet holding the cylinder valve in an open position against the force of the associated closing spring (that is, the other restoring spring).

To start an electromagnetic actuator of the above-described type, the two electromagnets are alternatingly supplied with current at the known resonant frequency of the spring-mass system which is composed of the restoring springs, the armature and the cylinder valve. The current supply at the resonant frequency is effected until the armature comes to rest at one of the electromagnets. By means of suitable data inputted in an engine control unit (ECU) which controls the energization of the two electromagnets, the oscillation-startup process may be terminated in such a manner that the armature comes to rest at a predetermined electromagnet, typically the closing magnet. In a multi-cylinder piston-type internal-combustion engine, the cylinder valves of the individual cylinder, or groups of cylinders, are brought into the closed position in this way by the oscillation startup, so that the individual cylinder valves can be actuated from the closed position to start the engine in the predetermined ignition- and work-cycle sequence.

To regulate the current supply, a sensor assembly responds as the armature approaches the capturing electromagnet, particularly to reduce the capturing current shortly before the armature impacts on the pole face of the capturing electromagnet. For this purpose a control signal may be emitted when the armature reaches a predetermined position relative to the pole face, or the traveled path is detected or, by derivation, the speed is determined or the speed is directly sensed. These approach-dependent values can be utilized by the engine control unit to reduce the capturing current such that the armature impacts the pole face gently, that is, with a speed slightly above "zero". As a result, the respective electromagnet has to be supplied only with a low holding current.

The above-outlined normal oscillation-startup method and normal operation, however, cannot be performed if at the engine, and particularly at the electromagnetic actuator, a low temperature level prevails. Such a low temperature, for example, appreciably increases the viscosity of the lubricating oil and/or changes the fit and thus increases the friction between the moving parts of the spring-mass system due to the heat-caused expansion of materials. A low temperature level in terms of the invention would be, for example, 0° C.

DESCRIPTION OF THE PREFERRED EMBODIMENTS OF THE METHOD ACCORDING TO THE INVENTION

It is an object of the invention to provide a problem-free startup and operation of an electromagnetic actuator According to an embodiment of the invention, this object is accomplished in that a reference temperature is detected for the electromagnets, and, in case of a normal temperature level, the armature is caused to start oscillation in the resonant frequency by an alternating energization of the electromagnets and is brought into engagement with a predeterminable pole face, preferably the pole face of the closing magnet. Or, in case of a low temperature level, a high current pulse is applied to one of the electromagnets, preferably the closing magnet.

The temperature of the cooling water or the oil of the piston-type internal-combustion engine can be predetermined as a reference temperature, or the solenoid temperature can be measured directly. Thus, it is feasible to use two different start strategies for engine startup, namely a startup oscillation at a normal temperature, or directly attracting the armature to the pole face of an electromagnet at a low temperature with a relatively high energy input.

To minimize the high current consumption in the cold-start strategy, an embodiment of the invention provides that the level of the high-current pulse is preset as a function of the level of the reference temperature. Such a procedure has the advantage that in an intermediate range between low and normal temperatures, in which the current supply is still controlled according to the cold-start strategy, not only the current consumption is reduced, but also the high impact energy can already be cut back.

A further embodiment of the invention provides that the current level of the electromagnet to which the high-current pulse is applied is controlled as a function of the approach of the armature toward the pole face in order to reduce the impact energy. Consequently, even in cold-start operation, despite the high current pulse and the associated high magnetic force that rapidly moves the armature toward the pole face, the impact energy can already be reduced during such approach by a reduction in the current level of the current pulse that is applied over a specific switching period. As a result, the restoring force of the restoring spring becomes more effective, and the armature impacts gently on the pole face. The method can also be modified such that the duration of the current pulse is controlled as a function of the armature approach, that is, the applied high-current pulse is cut off before the armature impacts the pole face. Such a moment can be ascertained based on the displacement and/or speed information of the sensor assembly.

A further embodiment of the invention provides that heat energy is supplied to at least one electromagnet of the electromagnetic actuator when a low temperature level is detected. The heat energy may be supplied to the electromagnet by a heating current. When a direct current is used as the heating current, however, ohmic losses must be taken into account. It is therefore advantageous to use a high-frequency alternating current as the heating current in order to generate eddy current-caused losses in the magnet yoke, the armature and the armature-guide bar, whereby the arrangement is heated by eddy currents. It is advantageous for the two electromagnets to be supplied alternatingly with a heating current to attain a uniform heating of the two electromagnets and to avoid local overheating.

Another embodiment of the invention provides that heat energy is alternatingly supplied to the two electromagnets as the armature moves slightly. In this procedure, an alternating current supply to the magnets causes the armature to move slightly, so that the guides heat up due to friction. The current supply may (but need not) be effected at the resonant frequency.

According to a further embodiment of the invention, at least one of the electromagnets is supplied with a current in the form of a start pulse. Further, depending on the initial movements of the armature as detected by the sensor, the subsequent supply of current to the electromagnets is controlled according to the normal startup-oscillation. Or, energization for the cold-start operation is effected by supplying the electromagnet with heat energy and/or with a high current pulse, or with a heating current and a subsequent energization for a startup oscillation. With this method the engine control unit performs an "oscillation test" for the electromagnetic actuator. Thus, the engine control unit can implement a cold-start strategy, without temperature detection, either at a current supply in the normal startup-oscillation or at a high-pulse current supply, possibly with the addition of heat energy, or by heating and subsequent startup oscillation.

In a further embodiment of the method according to the invention the engine control unit supplies the respective capturing electromagnet with a high-current pulse if the sensor assembly detects a reversal of armature movement before reaching the pole face. Such a malfunction can occur during startup or subsequent engine run if, due to stochastic external influences, the electrical energy supplied to the respective capturing electromagnet is insufficient to carry the armature into contact with the pole face. As a result, the force of the restoring spring would return the armature to the center position before the armature impacted the pole face. Such an occurrence can be detected by the sensor assembly, and can be "predicted" by the engine control unit not only based on the armature reversal prior to impact, but also based on displacement or speed data detected by the sensor assembly. It is therefore possible to "force" the armature to contact the pole face by immediately supplying a high-current pulse, so that the armature may then be again moved normally.

According to a further embodiment of the invention, for the normal current supply effecting a startup oscillation it is expedient to adjust the current intensity as a function of the displacement and/or speed values of the armature approach, as detected by the sensor. It is an advantage of such a method that an energy-wise optimal current supply to the coils of the two electromagnets is also obtained in a normal start operation, for example, while the engine is still warm. Heretofore the necessary parameters for the start, such as the current level and the number of alternating current supply steps of preset engine operating parameters had to be adjusted prior to the valve start, for example, via corresponding performance characteristics. According to this method of the invention, however, the necessary current level can be supplied immediately as the oscillation startup begins.

With the available sensor assembly it is also possible to determine whether a coil of an electromagnet is defective. During start operation in a normal startup-oscillation method such a defect may be ascertained by the fact that the movement detected by the sensor as the armature approaches the defective electromagnet does not correspond to predetermined values. In the high-pulse method a defect may be determined for the valve-closing side in that the corresponding signal does not reach the engine control unit via the sensor assembly. If in such a case the coil of the opening magnet is defective, such a defect can again be determined via the sensor assembly based on the value detection as the armature approaches the opening magnet. This is so because, in the event of a defect, the sensor indicates that a predetermined measurement point is passed by the armature too late and/or the armature speed is too low in the approach region. Thus, it is possible to implement a suitable control strategy, for example, to operate the electromagnetic actuator having a defective electromagnet. Therefore, in case of a defective opening magnet, the unaffected closing magnet is so operated that the respective cylinder valve is partially opened by the force of the restoring spring, and, for example, after the reversal of movement as compelled by the restoring spring, the armature is guided back into the closed position by a current pulse of suitably high intensity.

This procedure can also be implemented if, within the scope of the above-described starting strategy, it is ascertained by the engine control unit, via the sensor assembly, that the capture procedure would take place on the wrong side of the magnetic actuator at a "normal current supply." In such a case the current level is reduced on the "wrong" side, so that the electromagnet does not capture the armature there. Instead, the armature is not captured until it has passed through its center position again and reached the other, "correct" side with a controlled current supply.

The "wrong" side is normally understood as the side of the opening magnet, because the cylinder valve must usually be started from the closed position. In special cases, such as when the crankshaft should be able to be easily rotated during a cold start, the opening side can also be the "correct" side.

BRIEF DESCRIPTION OF THE DRAWING

The sole FIGURE is a schematic axial sectional view, with block diagram, of an ECU-controlled electromagnetic actuator for operating a cylinder valve by methods according to the invention.

DESCRIPTION OF THE PREFERRED EMBODIMENTS

An electromagnetic actuator 1 for operating a cylinder valve 2 essentially comprises a closing electromagnet 3 and an opening electromagnet 4 spaced therefrom. Between the electromagnets 3 and 4 an armature 5 is guided back and forth against the force of restoring springs, namely an opening spring 7 and a closing spring 8. The drawing illustrates the arrangement in the closed position, that is, in the "classic" arrangement of the opening and closing springs 7, 8. In such an arrangement the closing spring 8 acts directly on the cylinder valve 2 by way of a spring seat plate 2.2 connected to the stem 2.1 of the cylinder valve 2. The guide rod 11 of the electromagnetic actuator is separated from the valve stem 2.1; as a rule, a valve slack VS is present in the shown closed position of the cylinder valve 2. The opening spring 7 is supported on a spring seat plate 11.1 affixed to the guide rod 11. The guide rod 11 is supported on the valve stem 2.1 when the armature 5 is in its mid position between the two electromagnets 3 and 4 and is exposed to the opposing forces of the opening spring 7 and the closing spring 8.

It is also feasible to provide only a single restoring spring at the location of the opening spring 7. Such a single spring is so constructed that when the armature 5 overshoots the center position in either direction, the spring builds up and exerts a corresponding restoring force. Thus, while a separate closing spring 8 is omitted in such an arrangement, the guide rod 11 must be connected to the valve stem 2.1 by way of a coupling element that transmits the back-and-forth movement of the armature to the cylinder valve 2.

The closing spring 8 and the opening spring 7 are typically designed such that in the inoperative state, that is, when the electromagnets are not supplied with current, the armature 5 is located in the center position. Corresponding to the earlier-described method of starting up the engine, the electromagnetic actuator 1, with its cylinder valve 2, must be started from such a center position.

The electromagnets 3 and 4 of the actuator 1 are operated by an electronic engine control unit (ECU) 9, corresponding to the predetermined control programs and as a function of the operating data supplied by the valve timing, such as rpm, temperature, etc.

A symbolically shown sensor 10 is associated with the actuator 1 for detecting actuator functions. Depending on the sensor design, for example, the displacement of the armature 5 can be detected, so that the respective armature position can be reported to the ECU 9. The armature speed may also be determined in the ECU 9 by computation, so that the current supply to the two electromagnets 3, 4 can be controlled as a function of the armature position, and/or the armature speed.

The sensor 10 need not be arranged laterally of the armature 5, as illustrated; rather, it is feasible to place suitable sensors in the region of the pole face of the respective electromagnet, or to provide a sensor 10.1 adjacent a sensor rod 11.1 affixed to the armature 5.

The sensor, wherever located in the electromagnetic actuator, is a part of the complete sensor assembly of the ECU 9. In connection with the above-described-method of the invention, a temperature sensing ascertains the temperature level at one of the two electromagnets, depending on the method concept, or also evaluates for the method of the invention a temperature which is detected in any event by the ECU 9, such as the cooling-water temperature and/or the oil temperature. Such a component of the sensor assembly is not shown in the drawing; it is merely indicated by the measurement input T along with other input signals, such as the crankshaft rpm n.

The ECU 9 further has suitable means for detecting the current and the voltage for the respective electromagnets 3 and 4 and for changing the current and voltage courses. Depending on predeterminable operating programs, which may be based on corresponding performance characteristics, the ECU 9 can operate the actuator 1 of the cylinder valve 2 with full variability, as concerns, for example, the beginning and end of the "valve open" periods. Also, the amplitude of the opening stroke or the number of opening strokes during a closing period may be controlled.

It will be understood that the above description of the present invention is susceptible to various modifications, changes and adaptations, and the same are intended to be comprehended within the meaning and range of equivalents of the appended claims.

What is claimed is:

1. A method of starting an electromagnetic actuator for operating a cylinder valve of a piston-type internal-combustion engine, the actuator having two spaced electromagnets having respective pole faces oriented toward one another; one of the electromagnets being a valve-closing electromagnet and the other of the electromagnets being a valve-opening electromagnet;

a restoring spring;

an armature connected to the cylinder valve and being arranged for reciprocation between the electromagnets against the force of the restoring spring; and an ECU alternatingly supplying the electromagnets with a capturing current, the level of which being regulated as a function of the distance of the armature toward at least one pole face, the method comprising the following steps:

(a) detecting a temperature at least at one of the electromagnets;

(b) in case the temperature determined in step (a) is within a predetermined normal temperature range, (1) beginning to oscillate the armature by alternatingly supplying current to the electromagnets at a resonant frequency of an oscillating system comprising the armature, the cylinder valve and the restoring spring; and (2) bringing the armature into contact with one of the pole faces; and (c) in case the temperature determined in step (a) is below the predetermined normal temperature range, supplying one of the electromagnets with a high current pulse.

2. The method as defined in claim 1, further comprising the step of supplying heat energy to at least one of said electromagnets if a temperature below the predetermined normal temperature range is determined in step (a).

3. The method as defined in claim 2, wherein the step of supplying heat energy comprises the step of applying a heating current to at least one of said electromagnets.

4. The method as defined in claim 3, wherein the step of applying a heating current comprises the step of applying the heating current alternatingly to said electromagnets.

5. The method as defined in claim 4, further comprising the step of slightly moving the armature simultaneously with applying the heating current.

6. The method as defined in claim 3, wherein the step of applying a heating current comprises the step of applying a high frequency alternating current.

7. The method as defined in claim 1, further comprising the step for controlling the intensity of the high current pulse as a function of said distance for reducing an impact energy of the armature.

8. The method as defined in claim 1, step (c) further comprises the step of determining the intensity of the high current pulse as a function of the temperature detected in step (a).

9. The method as defined in claim 1, wherein said one pole face defined in step (b)(2) is the pole face of the valve-closing electromagnet and said one electromagnet defined in step (c) is the valve-opening electromagnet.

10. The method as defined in claim 1, further comprising the steps of energizing one of said electromagnets for causing said one electromagnet to act as a capturing electromagnet; detecting displacements of the armature and, simultaneously with said energizing step, applying a high current pulse to the capturing electromagnet if a reversal of armature movement prior to reaching an approached pole face is detected.

11. A method of starting an electromagnetic actuator for operating a cylinder valve of a piston-type internal-combustion engine, the actuator having two spaced electromagnets having respective pole faces oriented toward one another; one of the electromagnets being a valve-closing electromagnet and the other of the electromagnets being a valve-opening electromagnet;

a restoring spring;

an armature connected to the cylinder valve and being arranged for reciprocation between the electromagnets against the force of the restoring spring; and an ECU alternatingly supplying the electromagnets with a capturing current, the level of which being regulated as a function of the distance of the armature toward at least one pole face, the method comprising the following steps:

(a) energizing one of said electromagnets for causing said one electromagnet to act as a capturing electromagnet;

(b) detecting displacements of the armature; and (c) simultaneously with said energizing step, applying a high current pulse to the capturing electromagnet if a reversal of armature movement prior to reaching an approached pole face is detected.

* * * * *